US008974999B1

(12) United States Patent
Morales-Tirado et al.

(10) Patent No.: US 8,974,999 B1
(45) Date of Patent: Mar. 10, 2015

(54) SELF-CLEANING TONER COMPOSITION

(71) Applicant: Xerox Corporation, Norwalk, CT (US)

(72) Inventors: Juan A. Morales-Tirado, Henrietta, NY (US); Mark E. Mang, Rochester, NY (US); Michael F. Zona, Holley, NY (US); Samir Kumar, Pittsford, NY (US); Susan J. LaFica, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/033,224

(22) Filed: Sep. 20, 2013

(51) Int. Cl.

| | |
|---|---|
| ***G03G 9/00*** | (2006.01) |
| ***G03G 15/00*** | (2006.01) |
| ***G03G 9/087*** | (2006.01) |
| ***G03G 21/00*** | (2006.01) |

(52) U.S. Cl.
CPC ..... *G03G 9/08728* (2013.01); *G03G 21/0011* (2013.01)
USPC ..... 430/123.51; 430/108.6; 430/137.21; 399/252

(58) Field of Classification Search
USPC ..... 430/123.51, 108.6, 137.21; 399/252
See application file for complete search history.

(56) References Cited

U.S. PATENT DOCUMENTS

| | | | | |
|---|---|---|---|---|
| 6,057,073 | A | 5/2000 | Hagiwara | |
| 6,063,827 | A | 5/2000 | Sacripante et al. | |
| 6,197,470 | B1 * | 3/2001 | Tamura | 430/108.7 |
| 6,593,049 | B1 | 7/2003 | Veregin et al. | |
| 6,756,176 | B2 | 6/2004 | Stegamat et al. | |
| 6,830,860 | B2 | 12/2004 | Sacripante et al. | |
| 7,524,602 | B2 | 4/2009 | Vanbesien et al. | |

* cited by examiner

*Primary Examiner* — Thorl Chea
(74) *Attorney, Agent, or Firm* — Pillsbury Winthrop Shaw Pittman LLP

(57) ABSTRACT

Toner compositions that having spherical particles and provide stable density. The toner compositions also comprise and deliver a silicone oil to the cleaning subsystem in the image forming apparatus by incorporating an inorganic fine powder additive package that has been mixed with silicone oil in a manner such that the toner is blended with the inorganic fine powder and silicone oil.

20 Claims, 3 Drawing Sheets

CLEANING STREAK COUNT FROM TAPE TRANSFERS
PRINT COUNT (1000S)

| SAMPLE | OIL ADDITION METHOD | MEASURE d OIL CONTENT (ppm) | PAGE YIELD | GOOD / POOR | | | | | | | | | | | | | | | | | | STEAKS/kp (GOAL < 0.05) |
|---|---|---|---|---|---|---|---|---|---|---|---|---|---|---|---|---|---|---|---|---|---|---|
| | | | | 0 | 1 | 2 | 3 | 4 | 5 | 6 | 7 | 8 | 9 | 10 | 11 | 12 | 13 | 14 | 15 | 16 | | |
| CONTROL TONER EXAMPLE 3 | NONE | 0 | 13787 | 0 | 0 | 9 | 18 | 25 | 47 | 60 | 81 | | | | | | | | | | | 9.529 |
| EXAMPLE 1 | PRE-MIX | 955 | 13431 | 0 | 0 | 0 | 0 | 0 | 0 | 0 | 0 | 0 | 0 | 5 | 7 | 3 | 3 | | | | | 0.247 |
| EXAMPLE 2 | DIRECT | 2130 | 16105 | 0 | 0 | 0 | 0 | 0 | 0 | 0 | 0 | 1 | 0 | 0 | 0 | 0 | 0 | 0 | 0 | | | 0.006 |

FIG. 2

SELF-CLEANING TONER COMPOSITION

TECHNICAL FIELD

The presently disclosed embodiments are generally directed to toner compositions that have spherical particles and provide stable density. The toner compositions also comprise and deliver a silicone oil to the cleaning subsystem in the image forming apparatus. By incorporating the silicone oil directly into the toner composition during the formation of the toner, rather than either being premixed in an additive package that is separately added to the formed toner composition or being incorporated into the photoreceptor materials or being separately applied to the image forming apparatus components, the toner has greatly improved cleaning function. The present toner compositions thus provide both improved performance and cleaning. The toner of the present embodiments can be used in both single and two-component systems.

BACKGROUND

Electrophotography, which is a method for visualizing image information by forming an electrostatic latent image, is currently employed in various fields. The term "electrostatographic" is generally used interchangeably with the term "electrophotographic." In general, electrophotography comprises the formation of an electrostatic latent image on a photoreceptor, followed by development of the image with a developer containing a toner, and subsequent transfer of the image onto a transfer material such as paper or a sheet, and fixing the image on the transfer material by utilizing heat, a solvent, pressure and/or the like to obtain a permanent image.

In electrostatographic reproducing apparatuses, including digital, image on image, and contact electrostatic printing apparatuses, a light image of an original to be copied is typically recorded in the form of an electrostatic latent image upon a photosensitive member and the latent image is subsequently rendered visible by the application of electroscopic thermoplastic resin particles and pigment particles, or toner. Electrophotographic imaging members may include photosensitive members (photoreceptors) which are commonly utilized in electrophotographic (xerographic) processes, in either a flexible belt or a rigid drum configuration. Other members may include flexible intermediate transfer belts that are seamless or seamed, and usually formed by cutting a rectangular sheet from a web, overlapping opposite ends, and welding the overlapped ends together to form a welded seam. These electrophotographic imaging members comprise a photoconductive layer comprising a single layer or composite layers.

Conventional toner compositions suffer from issues such as lack of robustness, which is related to charge distribution and selective development. The present inventors have found that making the toner particles more spherical helps make the surface properties of the particles more uniform and hence facilitate a narrower charge distribution. This approach has been successful in stabilizing the density of the toner. The data obtained shows density dropping off over time (print count) with the lower circularity toner (for example, 0.975), as measured with a Sysmex 3000 shape analyzer. However, the more spherical toner particles (for example, 0.988) show much more stable development over time. However, robust machine components are required to clean the spherical particles at a high efficiency. Blade cleaning systems require a good balance between sufficient lubricity to prevent blade damage and sufficient normal force to prevent toner particles from getting past the blade nip. Prior methods to combat this issue involved impregnating the outer layer of photoreceptors with silicone oil. However, such methods proved cost prohibitive.

Thus, there is a desire to improve the characteristics and performance of toner compositions to address the above problems. The present embodiments are directed to toner compositions comprising silicone oil that provide improved cleanability and allow the use of spherical particles to achieve the desired density stability.

BRIEF SUMMARY

According to embodiments illustrated herein, there is provided a self-cleaning toner composition comprising a silicone oil that addresses the shortcomings discussed above.

An embodiment may include a process for producing a toner composition comprising: mixing together a resin, a colorant, a wax, and an optional charge control agent to form toner particles in a first mixing step; mixing together a first inorganic fine powder and silicone oil to form an oiled inorganic fine powder in a second mixing step; and adding the oiled inorganic fine powder to the toner particles and mixing the oiled inorganic fine powder and toner particles together to form final toner particles.

In another embodiment, there is provided a process for producing a toner composition comprising mixing together a resin, a colorant, a wax, and an optional charge control agent to form toner particles; adding a first inorganic fine powder and silicone oil to the toner particles and mixing the first inorganic fine powder, silicone oil and resin particles together to form final toner particles.

In another embodiment, there is provided a toner composition comprising toner particles further comprising a resin, a colorant, a wax, and an optional charge control agent; and an additive comprising a first inorganic fine powder and a silicone oil, wherein the first inorganic fine powder and a silicone oil are mixed directly with the toner particles to form final toner particles.

In yet another embodiment, there is provided an image forming system comprising: an electrostatic latent image bearing member for holding thereon an electrostatic latent image; a developing assembly for developing the electrostatic latent image held on the electrostatic latent image bearing member, wherein the developing assembly comprises a self-cleaning toner composition for developing an electrostatic latent image; a toner container for holding the self-cleaning toner composition; and a toner carrying member for carrying the self-cleaning toner composition held in the toner container and transporting the self-cleaning toner composition to an area on the electrostatic latent image bearing member where the electrostatic latent image is developed; and a cleaning unit for cleaning the surface of the electrostatic latent image bearing member, wherein the self-cleaning toner composition comprises final toner particles comprising toner particles further comprising a resin, a colorant, a wax, and an optional charge control agent; and an additive comprising a first inorganic fine powder and a silicone oil, wherein the first inorganic fine powder and a silicone oil are mixed directly with the toner particles to form the final toner particles.

BRIEF DESCRIPTION OF THE DRAWINGS

FIG. 2 is a chart showing the relative cleaning performance of a control toner without the additive as compared to toners made according to the present embodiments;

DETAILED DESCRIPTION

In the following description, it is understood that other embodiments may be used and structural and operational changes may be made without departing from the scope of the present disclosure.

The present embodiments provide a novel toner composition having a combination of specific characteristics and ingredients that operate together to provide a toner having more uniform and narrow charge distribution, and thus more stable density of the toner, while being self-cleaning. The term "self-cleaning" is used to mean that the toner compositions themselves incorporate certain additives that improve the cleanability of the toner particles from the imaging member.

The present toner compositions comprise silicone oil which greatly improves the cleaning function of the cleaning members in the image forming apparatus, for example, the cleaning blade. In addition, by incorporating the silicone oil into the toner composition rather than in the imaging member outer layers or delivering the silicone oil separately through other members, the present embodiments avoid the time and costs associated with requiring manufacturing of additional machine components or re-manufacturing existing components.

Figure 1:
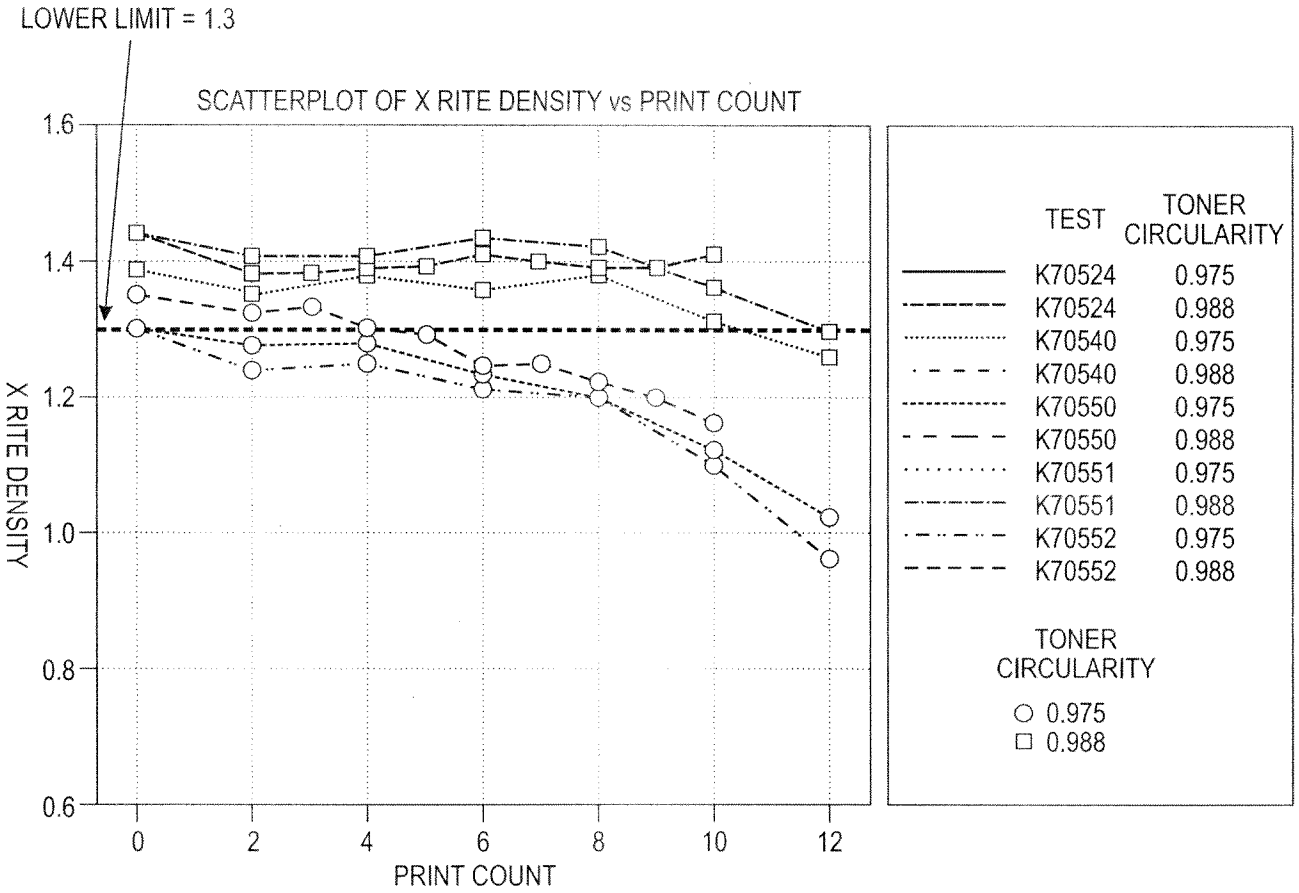
FIG. 1 is a chart showing a comparison of density performance between rough and circular particles.

In addition, the present embodiments provide toner compositions having small and more spherical toner particles. In embodiments, the toner particles have a circularity of from about 0.975 to about 0.995, or of from about 0.978 to about 0.990, or more preferably from about 0.980 to about 0.988, as measured with a Sysmex 3000 shape analyzer. In embodiments, the toner particles have an average particle size of from about 4 microns to about 9 microns or of from about 5 microns to about 8 microns, or more preferably from about 5.2 microns to about 7 microns. This approach has been successful in stabilizing the density of the toner. FIG. 1 provides a chart demonstrating the density performance as between rough and circular particles. The data obtained shows density dropping off over time (print count) with the lower circularity toner, for example, a circularity of lower than 0.975. The more spherical toner particles, such as for example, 0.988, show much more stable development over time. However, as mentioned above, robust machine components are required to clean the spherical particles at a high efficiency. For example, methods to combat this issue involved impregnating the outer layer of photoreceptors with silicone oil. However, such methods proved cost prohibitive.

The incorporation of the silicone oil into the present toner compositions provide a resolution to the cleaning issue without raising costs or adding to the manufacturing process of the machine components, while allowing for the use of the spherical toner particles for improved performance.

In the present embodiments, the toner composition can be a conventional toner or an emulsion aggregate (EA) toner. In embodiments, the toner composition comprises at least a binder resin, colorant, a silicone oil, and an inorganic fine powder. In other embodiments, some of the inorganic fine powder is pre-mixed with the silicone oil to form an oiled powder. The oiled powder is mixed with inorganic fine powder that was not oiled to form an additive package that is then added to the remaining toner components to blend and form the final toner composition.

Inorganic Fine Powder Additives

In embodiments, the silicone oil and inorganic fine powder are mixed in a mixing apparatus, such as for example, a blender to form the oiled inorganic fine powder. The mixing is done by adding the inorganic powder first and, while running the blender, an appropriate amount of silicone oil is added on top of the inorganic fine powder. This method of mixing ensures that excessive silicone oil does not collect on the walls and screw of the blender. The mixture is blended for about 30 to about 600 seconds, or about 45 to about 300 seconds, or, more preferably about 60 to about 240 seconds. In embodiments, the mixing is done in separate bursts, with a pause in mixing in between each burst. In embodiments, the pause is for the same amount of time as that used for each burst of mixing. This ensures that the oil and inorganic fine powder are properly mixed and the oil uniformly coats the inorganic fine powder particles without excessive heat being generated in the mixing apparatus.

The oiled inorganic fine powder is mixed with the non-oiled inorganic fine powder in the desired weight ratios and added to the toner particles. The additive package is then mixed further with the toner to make sure that the oiled inorganic powder properly adheres to the toner. More specifically, after the silicone and inorganic fine powder are mixed, the remaining toner components are added into the mix to continue blending to form the final toner product. Incorporating the additive package in this manner ensures the consistency of oiled inorganic powder in the final toner product. In particular, it is desirable to incorporate oiled inorganic powders having the same amount of silicone oil. Prior methods which form the additive package and then separately add the additive package to a toner, such as for example, U.S. Pat. No. 6,057,073, result in inconsistently oiled inorganic powders and require heat treatment of the silicone oil to the inorganic fine powder prior to use as a toner additive. In addition, by heat treating as in U.S. Pat. No. 6,057,073, the silicone oil becomes highly attached to the inorganic fine powder which prevents the lubricating function of the oil in the cleaning blade contact nip.

In these embodiments, the additive package of oiled and non-oiled inorganic fine powder is present in the toner composition in an amount of from about 10 to about 95%, or from about 15 to about 75%, or from about 20 to about 60% by weight percent.

In the present embodiments, the inorganic fine powder may include metal oxides of metals such as silicon, titanium, aluminum, germanium, magnesium, zinc, cerium, cobalt, iron, zirconium, chromium, manganese, strontium, tin, antimony, molybdenum and tungsten; oxides such as boron oxide; nitrides such as silicon nitride and germanium nitride; composite metal oxides such as calcium titanate, magnesium titanate, strontium titanate, tungstophosphoric acid and molybdophosphoric acid; metal salts such as calcium carbonate, magnesium carbonate and aluminum carbonate; clay minerals such as kaolin; phosphorus compounds such as apatite; carbides such as silicon carbide and titanium carbide; silicon compounds; and carbon powders such as carbon black and graphite; and mixtures thereof.

Examples of the inorganic fine powder include fine powders of, for example, silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide and silicon nitride. In a specific embodiment, the inorganic fine powder is a small silica powder.

Also, known materials such as resin fine powder may be used in combination with the above inorganic fine powder. Moreover, a metal salt of higher fatty acid represented by zinc stearate and fluorine type high-molecular weight fine particle powder may be added as a cleaning activator.

In embodiments, the silicone oil used may include, for example, dimethylsilicone oil, methylphenylsilicone oil, methylhydrogensilicone oil, alkyl-modified silicone oils, chloroalkyl-modified silicone oils, chlorophenyl-modified silicone oils, fatty acid-modified silicone oils, polyether-modified silicone oils, alkoxy-modified silicone oils, carbinol-modified silicone oils, amino-modified silicone oils and fluorine-modified silicone oils, and mixtures thereof.

The silicone oil may have a viscosity of from about 10 to about 1000 centistokes, or from about 50 to about 500 centistokes, or, more preferably from about 200 to about 400 centistokes at room temperature (e.g., 20-27° C.).

In more preferred embodiments, the silicone oil and inorganic fine powder are blended directly with the fine resin particles in a blender, without pre-blending the oil with the inorganic fine powder. In this way, the silicone oil is allowed to coat the individual toner particles instead of just the inorganic fine particles. This provides more efficient delivery of oil to the interface between the cleaner blade and the photoreceptor surface. It has been shown by the inventors that the homogeneity of the oil distribution within a batch of toner is much better than when pre-mixing the oil with the inorganic fine powder prior to blending with the toner particles. In the case of pre-mixing, the inorganic fine particles with high coverage of silicone oil tend to sink to the bottom of the transport vessel, leaving poorly covered particles at the top. Unless the entire transport vessel of oiled inorganic fine particles is used in the blending of the final toner, the oil content in the finished toner can vary greatly batch to batch. By adding the oil during the toner blending step, in parallel with the inorganic fine powder, the uniformity of the oil, both within the batch and from batch to batch is greatly improved.

Regardless of the method used to incorporate the silicone oil, the final toner should contain between 500 and 3500 parts per million (ppm) of silicone oil in the blended toner, or 1000 to 3000 ppm of silicone oil in the blended toner, or, more preferably, 1800 to 2700 ppm of silicone oil in the blended toner. Silicone oil levels below 1800 parts per million do not provide sufficient lubrication to the cleaning system which creates cleaning defects. Silicone oil levels above 2700 ppm begin to reduce the tribo charge of the toner which leads to higher background development and reduced density. Silicone oil content is measured using kerosene extraction described below:

Duplicate samples each of 0.5 g toner were extracted in 25 ml kerosene on a box shaker for 1 hour. Exact sample weights were recorded. Samples were centrifuged at 4000 rpm for 4 minutes. The supernatant was analyzed by ICP for the Si content. The calibration curve was constructed using DOW PMX-200 350 cs oil.

In addition to the binder resin, colorant and inorganic fine powder, the toner can further comprise a wax and/or one or more additives.

Latex Resin

In embodiments, a developer is disclosed including a resin coated carrier and a toner, where the toner may be an emulsion aggregation toner, containing, but not limited to, a latex resin, a wax and a polymer shell.

In embodiments, the latex resin may be composed of a first and a second monomer composition. Any suitable monomer or mixture of monomers may be selected to prepare the first monomer composition and the second monomer composition. The selection of monomer or mixture of monomers for the first monomer composition is independent of that for the second monomer composition and vise versa. Exemplary monomers for the first and/or the second monomer compositions include, but are not limited to, polyesters, styrene, alkyl acrylate, such as, methyl acrylate, ethyl acrylate, butyl arylate, isobutyl acrylate, dodecyl acrylate, n-octyl acrylate, 2-chloroethyl acrylate; β-carboxy ethyl acrylate (β-CEA), phenyl acrylate, methyl alphachloroacrylate, methyl methacrylate, ethyl methacrylate and butyl methacrylate; butadiene; isoprene; methacrylonitrile; acrylonitrile; vinyl ethers, such as, vinyl methyl ether, vinyl isobutyl ether, vinyl ethyl ether and the like; vinyl esters, such as, vinyl acetate, vinyl propionate, vinyl benzoate and vinyl butyrate; vinyl ketones, such as, vinyl methyl ketone, vinyl hexyl ketone and methyl isopropenyl ketone; vinylidene halides, such as, vinylidene chloride and vinylidene chlorofluoride; N-vinyl indole; N-vinyl pyrrolidone; methacrylate; acrylic acid; methacrylic acid; acrylamide; methacrylamide; vinylpyridine; vinylpyrrolidone; vinyl-N-methylpyridinium chloride; vinyl naphthalene; p-chlorostyrene; vinyl chloride; vinyl bromide; vinyl fluoride; ethylene; propylene; butylenes; isobutylene; and the like, and mixtures thereof. In case a mixture of monomers is used, typically the latex polymer will be a copolymer.

In some embodiments, the first monomer composition and the second monomer composition may independently of each other comprise two or three or more different monomers. The latex polymer therefore can comprise a copolymer. Illustrative examples of such a latex copolymer includes poly(styrene-n-butyl acrylate-β-CEA), poly(styrene-alkyl acrylate), poly(styrene-1,3-diene), poly(styrene-alkyl methacrylate), poly(alkyl methacrylate-alkyl acrylate), poly(alkyl methacrylate-aryl acrylate), poly(aryl methacrylate-alkyl acrylate), poly(alkyl methacrylate), poly(styrene-alkyl acrylate-acrylonitrile), poly(styrene-1,3-diene-acrylonitrile), poly (alkyl acrylate-acrylonitrile), poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylonitrile), poly(styrene-butyl acrylate-acrylononitrile), and the like.

In embodiments, the first monomer composition and the second monomer composition may be substantially water insoluble, such as, hydrophobic, and may be dispersed in an aqueous phase with adequate stirring when added to a reaction vessel.

The weight ratio between the first monomer composition and the second monomer composition may be in the range of from about 0.1:99.9 to about 50:50, including from about 0.5:99.5 to about 25:75, from about 1:99 to about 10:90.

In embodiments, the first monomer composition and the second monomer composition can be the same. Examples of the first/second monomer composition may be a mixture comprising styrene and alkyl acrylate, such as, a mixture comprising styrene, n-butyl acrylate and β-CEA. Based on total weight of the monomers, styrene may be present in an amount from about 1% to about 99%, from about 50% to about 95%, from about 70% to about 90%, although may be present in greater or lesser amounts; alkyl acrylate, such as, n-butyl acrylate, may be present in an amount from about 1% to about 99%, from about 5% to about 50%, from about 10% to about 30%, although may be present in greater or lesser amounts.

In embodiments, the resins may be a polyester resin, such as, an amorphous resin, a crystalline resin, and/or a combination thereof, including the resins described in U.S. Pat. Nos. 6,593,049 and 6,756,176, the disclosure of each of which hereby is incorporated by reference in entirety. Suitable resins may also include a mixture of an amorphous polyester resin and a crystalline polyester resin as described in U.S. Pat. No. 6,830,860, the disclosure of which is hereby incorporated by reference in entirety.

In embodiments, the resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol may be, for example, selected in an amount of from about 40 to about 60 mole percent, in embodiments from about 42 to about 55 mole percent, in embodiments from about 45 to about 53 mole percent (although amounts outside of these ranges can be used), and the alkali sulfo-aliphatic diol can be selected in an amount of from about 0 to about 10 mole percent, in embodiments from about 1 to about 4 mole percent of the resin.

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis, 1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassio salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid may be selected in an amount of, for example, in embodiments from about 40 to about 60 mole percent, in embodiments from about 42 to about 52 mole percent, in embodiments from about 45 to about 50 mole percent, and the alkali sulfo-aliphatic diacid can be selected in an amount of from about 1 to about 10 mole percent of the resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), alkali copoly(5-sulfoisophthaloyl)-copoly(ethylene-adipate), alkali copoly(5-sulfoisophthaloyl)-copoly(propylene-adipate), alkali copoly(5-sulfoisophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfoisophthaloyl)-copoly(ethylene-succinate), alkali copoly(5-sulfoisophthaloyl)-copoly(propylene-succinate), alkali copoly(5-sulfoisophthaloyl)-copoly(butylenes-succinate), alkali copoly(5-sulfoisophthaloyl)-copoly(pentylene-succinate), alkali copoly(5-sulfoisophthaloyl)-copoly(hexylene-succinate), alkali copoly(5-sulfoisophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly(hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate), wherein alkali is a metal like sodium, lithium or potassium. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 3 to about 4.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin. Examples of the alkylene oxide adducts of bisphenol include polyoxypropylene (2.2)-2,2-bis(4-hydroxyphenyl)propane, polyoxypropylene (3.3)-2,2-bis(4-hydroxyphenyl)propane, polyoxyethylene (2.0)-2,2-bis(4-hydroxyphenyl)propane, polyoxyethylene (2.2)-2,2-bis(4-hydroxyphenyl)propane, polyoxypropylene (2.0)-polyoxyethylene (2.0)-2,2-bis(4-hydroxyphenyl)propane, and polyoxypropylene (6)-2,2-bis(4-hydroxyphenyl)propane. These compounds may be used singly or as a combination of two or more thereof.

Examples of additional diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, 1,4-cyclohexanedimethanol, 1,3-cyclohexanedimethanol, xylenedimethanol, cyclohexanediol, diethylene glycol, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

Furthermore, in embodiments, a crystalline polyester resin may be contained in the binding resin. The crystalline polyester resin may be synthesized from an acid (dicarboxylic acid) component and an alcohol (diol) component. In what follows, an "acid-derived component" indicates a constituent moiety that was originally an acid component before the synthesis of a polyester resin and an "alcohol-derived component" indicates a constituent moiety that was originally an alcoholic component before the synthesis of the polyester resin.

A "crystalline polyester resin" indicates one that shows not a stepwise endothermic amount variation but a clear endothermic peak in differential scanning calorimetry (DSC). However, a polymer obtained by copolymerizing the crystalline polyester main chain and at least one other component is also called a crystalline polyester if the amount of the other component is 50% by weight or less.

As the acid-derived component, an aliphatic dicarboxylic acid may be utilized, such as a straight chain carboxylic acid. Examples of straight chain carboxylic acids include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,1-undecanedicarboxylic acid, 1,12-dodecanedicarboxylic acid, 1,13-tridecanedicarboxylic acid, 1,14-tetradecanedicarboxylic acid, 1,16-hexadecanedicarboxylic acid, and 1,18-octadecanedicarboxylic acid, as well as lower alkyl esters and acid anhydrides thereof. Among these, acids having 6 to 10 carbon atoms may be desirable for obtaining suitable crystal melting point and charging properties. In order to improve the crystallinity, the straight chain carboxylic acid may be present in an amount of about 95% by mole or more of the acid component and, in embodiments, more than about 98% by mole of the acid component. Other acids are not particularly restricted, and examples thereof include conventionally known divalent carboxylic acids and dihydric alcohols, for example those described in "Polymer Data Handbook: Basic Edition" (Soc. Polymer Science, Japan Ed.: Baihukan). Specific examples of the monomer components include, as divalent carboxylic acids, dibasic acids such as phthalic acid, isophthalic acid, terephthalic acid, naphthalene-2,6-dicarboxylic acid, naphthalene-2,7-dicarboxylic acid, and cyclohexanedicarboxylic acid, and anhydrides and lower alkyl esters thereof, as well as combinations thereof, and the like. As the acid-derived component, a component such as a dicarboxylic acid-derived component having a sulfonic acid group may also be utilized. The dicarboxylic acid having a sulfonic acid group may be effective for obtaining excellent dispersion of a coloring agent such as a pigment. Furthermore, when a whole resin is emulsified or suspended in water to prepare a toner mother particle, a sulfonic acid group, may enable the resin to be emulsified or suspended without a surfactant. Examples of such dicarboxylic acids having a sulfonic group include, but are not limited to, sodium 2-sulfoterephthalate, sodium 5-sulfoisophthalate and sodium sulfosuccinate. Furthermore, lower alkyl esters and acid anhydrides of such dicarboxylic acids having a sulfonic group, for example, are also usable. Among these, sodium 5-sulfoisophthalate and the like may be desirable in view of the cost. The content of the dicarboxylic acid having a sulfonic acid group may be from about 0.1% by mole to about 2% by mole, in embodiments from about 0.2% by mole to about 1% by mole. When the content is more than about 2% by mole, the charging properties may be deteriorated. Here, "component mol %" or "component mole %" indicates the percentage when the total amount of each of the components (acid-derived component and alcohol-derived component) in the polyester resin is assumed to be 1 unit (mole).

As the alcohol component, aliphatic dialcohols may be used. Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-dodecanediol, 1,12-undecanediol, 1,13-tridecanediol, 1,14-tetradecanediol, 1,18-octadecanediol and 1,20-eicosanediol. Among them, those having from about 6 to about 10 carbon atoms may be used to obtain desirable crystal melting points and charging properties. In order to raise crystallinity, it may be useful to use the straight chain dialcohols in an amount of about 95% by mole or more, in embodiments about 98% by mole or more.

Examples of other dihydric dialcohols which may be utilized include bisphenol A, hydrogenated bisphenol A, bisphenol A ethylene oxide adduct, bisphenol A propylene oxide adduct, 1,4-cyclohexanediol, 1,4-cyclohexanedimethanol, diethylene glycol, propylene glycol, dipropylene glycol, 1,3-butanediol, neopentyl glycol, combinations thereof, and the like.

For adjusting the acid number and hydroxyl number, the following may be used: monovalent acids such as acetic acid and benzoic acid; monohydric alcohols such as cyclohexanol and benzyl alcohol; benzenetricarboxylic acid, naphthalenetricarboxylic acid, and anhydrides and lower alkylesters thereof; trivalent alcohols such as glycerin, trimethylolethane, trimethylolpropane, pentaerythritol, combinations thereof, and the like.

The crystalline polyester resins may be synthesized from a combination of components selected from the above-mentioned monomer components, by using conventional known methods. Exemplary methods include the ester exchange method and the direct polycondensation method, which may be used singularly or in a combination thereof. The molar ratio (acid component/alcohol component) when the acid component and alcohol component are reacted, may vary depending on the reaction conditions. The molar ratio is usually about 1/1 in direct polycondensation. In the ester exchange method, a monomer such as ethylene glycol, neopentyl glycol or cyclohexanedimethanol, which may be distilled away under vacuum, may be used in excess.

Surfactants

Any suitable surfactants may be used for the preparation of the latex and wax dispersions according to the present disclosure. Depending on the emulsion system, any desired nonionic or ionic surfactant such as anionic or cationic surfactant may be contemplated.

Examples of suitable anionic surfactants include, but are not limited to, sodium dodecylsulfate, sodium dodecylbenzene sulfonate, sodium dodecylnaphthalenesulfate, dialkyl benzenealkyl sulfates and sulfonates, abitic acid, NEOGEN R® and NEOGEN SC® available from Kao, Tayca Power®, available from Tayca Corp., DOWFAX®, available from Dow Chemical Co., and the like, as well as mixtures thereof. Anionic surfactants may be employed in any desired or effective amount, for example, at least about 0.01% by weight of total monomers used to prepare the latex polymer, at least about 0.1% by weight of total monomers used to prepare the latex polymer; and no more than about 10% by weight of total monomers used to prepare the latex polymer, no more than about 5% by weight of total monomers used to prepare the latex polymer, although the amount can be outside of those ranges.

Examples of suitable cationic surfactants include, but are not limited to, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$ and $C_{17}$ trimethyl ammonium bromides, halide salts of quaternized polyoxyethylalkylamines, dodecylbenzyl triethyl ammonium chloride, MIRAPOL® and ALKAQUAT® (available from Alkaril Chemical Company), SANIZOL® (benzalkonium chloride, available from Kao Chemicals), and the like, as well as mixtures thereof.

Examples of suitable nonionic surfactants include, but are not limited to, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy)ethanol (available from Rhone-Poulenc as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890®, and ANTAROX 897®) and the like, as well as mixtures thereof.

Initiators

Any suitable initiator or mixture of initiators may be selected in the latex process and the toner process. In embodiments, the initiator is selected from known free radical polymerization initiators. The free radical initiator can be any free radical polymerization initiator capable of initiating a free radical polymerization process and mixtures thereof, such free radical initiator being capable of providing free radical species on heating to above about 30° C.

Although water soluble free radical initiators are used in emulsion polymerization reactions, other free radical initiators also can be used. Examples of suitable free radical initiators include, but are not limited to, peroxides, such as, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, diisopropyl peroxycarbonate, tetralin hydroperoxide, 1-phenyl-2-methylpropyl-1-hydroperoxide and tert-butylhydroperoxide; pertriphenylacetate, tert-butyl performate; tert-butyl peracetate; tert-butyl perbenzoate; tert-butyl perphenylacetate; Cert-butyl permethoxyacetate; tert-butyl per-N-(3-toluoyl)carbamate; sodium persulfate; potassium persulfate, azo compounds, such as, 2,2"-azobispropane, 2,2'-dichloro-2,2'-azobispropane, 1,1'-azo(methylethyl)diacetate, 2,2'-azobis(2-amidinopropane)hydrochloride, 2,2'-azobis(2-amidinopropane)-nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonodinitrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1"-azobis-1-chlorophenylethane, 1,1-azobis-1-cyclohexanecarbonitrile, 1,1'-azobis-1-cycloheptanenitrile, 1,1"-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1'-azobis-1,2-diphenylethane, poly(bisphenol A-4,4'-azobis-4-cyanopentano-ate) and poly(tetraethylene glycol-2,2'-azobisisobutyrate); 1,4-bis(pentaethylene)-2-tetrazene; 1,4-dimethoxycarbonyl-1,4-dipheny-l-2-tetrazene and the like; and mixtures thereof.

More typical free radical initiators include, but are not limited to, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, sodium persulfate, potassium persulfate, diisopropyl peroxycarbonate and the like.

Based on total weight of the monomers to be polymerized, the initiator may be present in an amount from about 0.1% to about 5%, from about 0.4% to about 4%, from about 0.5% to about 3%, although may be present in greater or lesser amounts.

A chain transfer agent optionally may be used to control the polymerization degree of the latex, and thereby control the molecular weight and molecular weight distribution of the product latexes of the latex process and/or the toner process according to the present disclosure. As can be appreciated, a chain transfer agent can become part of the latex polymer.

Chain Transfer Agent

In embodiments, the chain transfer agent has a carbon-sulfur covalent bond. The carbon-sulfur covalent bond has an absorption peak in a wave number region ranging from 500 to 800 $cm^{-1}$ in an infrared absorption spectrum. When the chain transfer agent is incorporated into the latex and the toner made from the latex, the absorption peak may be changed, for example, to a wave number region of 400 to 4,000 $cm^{-1}$.

Exemplary chain transfer agents include, but are not limited to, n-$C_{3-15}$ alkylmercaptans, such as, n-propylmercaptan, n-butylmercaptan, n-amylmercaptan, n-hexylmercaptan, n-heptylmercaptan, n-octylmercaptan, n-nonylmercaptan, n-decylmercaptan and n-dodecylmercaptan; branched alkylmercaptans, such as, isopropylmercaptan, isobutylmercaptan, s-butylmercaptan, tert-butylmercaptan, cyclohexylmercaptan, tert-hexadecylmercaptan, tert-laurylmercaptan, tert-nonylmercaptan, tert-octylmercaptan and tert-tetradecylmercaptan; aromatic ring-containing mercaptans, such as, allylmercaptan, 3-phenylpropylmercaptan, phenylmercaptan and mercaptotriphenylmethane; and so on. The terms, mercaptan and thiol may be used interchangeably to mean C—SH group.

Examples of such chain transfer agents also include, but are not limited to, dodecanethiol, butanethiol, isooctyl-3-mercaptopropionate, 2-methyl-5-t-butyl-thiophenol, carbon tetrachloride, carbon tetrabromide and the like.

Based on total weight of the monomers to be polymerized, the chain transfer agent may be present in an amount from about 0.1% to about 7%, from about 0.5% to about 6%, from about 1.0% to about 5%, although may be present in greater or lesser amounts.

In embodiments, a branching agent optionally may be included in the first/second monomer composition to control the branching structure of the target latex. Exemplary branching agents include, but are not limited to, decanediol diacrylate (ADOD), trimethylolpropane, pentaerythritol, trimellitic acid, pyromellitic acid and mixtures thereof.

Based on total weight of the monomers to be polymerized, the branching agent may be present in an amount from about 0% to about 2%, from about 0.05% to about 1.0%, from about 0.1% to about 0.8%, although may be present in greater or lesser amounts.

In the latex process and toner process of the disclosure, emulsification may be done by any suitable process, such as, mixing at elevated temperature. For example, the emulsion mixture may be mixed in a homogenizer set at about 200 to about 400 rpm and at a temperature of from about 40° C. to about 80° C. for a period of from about 1 min to about 20 min.

Any type of reactor may be used without restriction. The reactor can include means for stirring the compositions therein, such as, an impeller. A reactor can include at least one impeller. For forming the latex and/or toner, the reactor can be operated throughout the process such that the impellers can operate at an effective mixing rate of about 10 to about 1,000 rpm.

Following completion of the monomer addition, the latex may be permitted to stabilize by maintaining the conditions for a period of time, for example for about 10 to about 300 min, before cooling. Optionally, the latex formed by the above process may be isolated by standard methods known in the art, for example, coagulation, dissolution and precipitation, filtering, washing, drying or the like.

The latex of the present disclosure may be selected for emulsion-aggregation-coalescence processes for forming toners, inks and developers by known methods. The latex of the present disclosure may be melt blended or otherwise mixed with various toner ingredients, such as, a wax dispersion, a coagulant, an optional silica, an optional charge enhancing additive or charge control additive, an optional surfactant, an optional emulsifier, an optional flow additive and the like. Optionally, the latex (e.g. around 40% solids) may be diluted to the desired solids loading (e.g. about 12 to about 15% by weight solids), before formulated in a toner composition.

Based on the total toner weight, the latex may be present in an amount from about 50% to about 100%, from about 60% to about 98%, from about 70% to about 95%, although may be present in greater or lesser amounts. Methods of producing such latex resins may be carried out as described in the disclosure of U.S. Pat. No. 7,524,602, herein incorporated by reference in entirety.

Colorants

Various known suitable colorants, such as dyes, pigments, mixtures of dyes, mixtures of pigments, mixtures of dyes and pigments and the like may be included in the toner. The colorant may be included in the toner in an amount of, for example, about 0.1 to about 35% by weight of the toner, from about 1 to about 15% percent of the toner, from about 3 to about 10% by weight of the toner, although amounts outside those ranges may be utilized.

As examples of suitable colorants, mention may be made of carbon black like REGAL 330®; magnetites, such as, Mobay magnetites MO8029™ and MO8060™; Columbian magnetites; MAPICO BLACKS™, surface-treated magnetites; Pfizer magnetites CB4799™, CB5300™, CB5600™ and MCX6369™; Bayer magnetites, BAYFERROX 8600™ and 8610™; Northern Pigments magnetites, NP-604™ and NP-608™; Magnox magnetites TMB-100™ or TMB-104™; and the like. As colored pigments, there can be selected cyan, magenta, yellow, red, green, brown, blue or mixtures thereof. Generally, cyan, magenta or yellow pigments or dyes, or mixtures thereof, are used. The pigment or pigments can be water-based pigment dispersions.

Specific examples of pigments include SUNSPERSE 6000, FLEXIVERSE and AQUATONE water-based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™ PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, CINQUASIA MAGENTA™ available from E.I. DuPont de Nemours & Company and the like. Colorants that can be selected are black, cyan, magenta, yellow and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19 and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, Anthrathrene Blue, identified in the Color Index as CI 69810, Special Blue X-2137 and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide and Permanent Yellow FGL. Colored magnetites, such as, mixtures of MAPICO BLACK™, and cyan components also may be selected as colorants. Other known colorants can be selected, such as, Levanyl Black A-SF (Miles, Bayer) and Sunsperse Carbon Black LHD 9303 (Sun Chemicals), and colored dyes, such as, Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy). Paliogen Red 3871K (BASF), Paliogen Red 3340 (BASF), Lithol Fast Scarlet L4300 (BASF), combinations of the foregoing and the like.

Wax

In addition to the polymer resin, the toners of the present disclosure also may contain a wax, which can be either a single type of wax or a mixture of two or more different waxes. A single wax can be added to toner formulations, for example, to improve particular toner properties, such as, toner particle shape, presence and amount of wax on the toner particle surface, charging and/or fusing characteristics, gloss, stripping, offset properties and the like. Alternatively, a combination of waxes can be added to provide multiple properties to the toner composition.

When included, the wax may be present in an amount of, for example, from about 1 wt % to about 25 wt % of the toner particles, in embodiments, from about 5 wt % to about 20 wt % of the toner particles.

Waxes that may be selected include waxes having, for example, a weight average molecular weight of from about 500 to about 20,000, in embodiments from about 1,000 to about 10,000. Waxes that may be used include, for example, polyolefins, such as, polyethylene, polypropylene and polybutene waxes, such as, commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as, carnauba wax, rice wax, candelilla wax, sumacs wax and jojoba oil; animal-based waxes, such as, beeswax; mineral-based waxes and petroleum-based waxes, such as, montan wax, ozokerite, ceresin, paraffin wax, microcrystalline wax and Fischer-Tropsch wax; ester waxes obtained from higher fatty acid and higher alcohol, such as, stearyl stearate and behenyl behenate; ester waxes obtained from higher fatty acid and monovalent or multivalent lower alcohol, such as, butyl stearate, propyl oleate, glyceride monostearate, glyceride distearate, pentaerythritol tetra behenate; ester waxes obtained from higher fatty acid and multivalent alcohol multimers, such as, diethyleneglycol monostearate, dipropyleneglycol distearate, diglyceryl distearate and triglyceryl tetrastearate; sorbitan higher fatty acid ester waxes, such as, sorbitan monostearate, and cholesterol higher fatty acid ester waxes, such as, cholesteryl stearate. Examples of functionalized waxes that may be used include, for example, amines, amides, for example, AQUA SUPERSLIP 6550™ and SUPERSLIP6530™ available from Micro Powder Inc., fluorinated waxes, for example, POLYFLUO 190™, POLYFLUO 200™, POLYSILK 19™ and POLYSILK 14™ available from Micro Powder Inc., mixed fluorinated, amide waxes, for example, MICROSPERSION19™ available from Micro Powder Inc., imides, esters, quaternary amines, carboxylic acids or acrylic polymer emulsion, for example JONCRYL 74™, 89™ 130™, 537™ and 538™, all available from SC Johnson Wax, and chlorinated polypropylenes and polyethylenes available from Allied Chemical and Petrolite Corporation and SC Johnson wax. Mixtures and combinations of the foregoing waxes also may be used in embodiments. Waxes may be included as, for example, fuser roll release agents.

The toner composition can be prepared by a number of known methods including melt mixing the toner resin particles, and pigment particles or colorants, followed by mechanical attrition. Other methods include those well known in the art such as melt dispersion, dispersion polymerization, suspension polymerization, extrusion, and emulsion/aggregation processes.

The resulting toner particles can then be formulated into a developer composition. The toner particles can be mixed with carrier particles to achieve a two-component developer composition.

In embodiments, a charge control agent is added. In further embodiments, the charge control agent is an internal charge control agent, such as an acryl base polymeric charge control agent. In particular embodiments, the toner contains between about 0.5% and 7% by weight of the internal charge control agent.

The toner may be made by admixing resin, wax, the pigment/colorant, and the one or more additives. The admixing may be done in an extrusion device. The extrudate may then be ground, for example in a jet mill, followed by classification to provide a toner having a desired volume average particle size, for example, from about 7.5 to about 9.5 microns, or in a specific embodiment, about 8.4±0.5 microns. The classified toner is blended with external additives, which are specifically formulated in a Henschel blender and subsequently screening the toner through a screen, such as a 37 micron screen, to eliminate coarse particles or agglomerate of additives.

EXAMPLES

The examples set forth herein below and are illustrative of different compositions and conditions that can be used in practicing the present embodiments. All proportions are by weight unless otherwise indicated. It will be apparent, however, that the present embodiments can be practiced with many types of compositions and can have many different uses in accordance with the disclosure above and as pointed out hereinafter. The resins used in these examples are defined below:

Example 1

Preparation of Inorganic Fine Powder Additive Package

A silicone oil (Dow PMX-200 from Dow Chemicals) and a small silica (TG308F from Cabot Corporation) are mixed in a blender to provide an additive package for later blending with EA toner particles. The following equipment and conditions were used: 10 L Henschel, Tool—Standard, Tool Speed—2550 rpms, Silica loading—300 grams.

The blender was loaded with 300 grams of TG308F silica. The silicone oil was added with a syringe in the amount required (ml) based on the oil to silica ratio. For example, a 0.30 ml/g ratio will require 90 ml of oil. The blender was closed and run for 30 seconds. The impeller was turned off and the batch was held in the blender for 30 seconds. The impeller was then turned on and run for another 30 seconds. The impeller was then turned off and the batch discharged.

Preparation of Toner Sample with Premixed Oil Silica

A premix of silicone oil (Dow PMX-200) and small silica (TG308F) is done prior to toner blending, as described above, to provide an additive composition that delivers the oil to the cleaning blade subsystem in the machine. The total amount of silica used in the design was 1.4% by weight of the toner being blended. It is proposed to use a ratio of oiled silica to un-oiled silica in the range of 0.2:1.0 to 0.8:1.0. This range provides sufficient oil for blade lubrication, but not so much that the critical components in the xerographic system get contaminated with oil. Thus, the ratio of oiled inorganic fine powder to non-oiled inorganic fine powder must be carefully crafted. Successful cleaning has been observed using 50% oiled silica (0.7% by weight of toner) and 50% TG308F without oil (0.7% by weight). The Henshel blender is used to adhere the mix of silicas (oiled and non-oiled) to the toner particle.

The final toner is removed and air-jet screened through a 37 um mesh screen to remove any coarse particles prior to installation into the machine for testing. This resin particle was 5.8 μm in diameter on average and nearly spherical with a circularity 0.988.

Example 2

Preparation of InventiveToner Sample

In a Henshel blender, 3.3 pounds of Styrene/Acrylate resin particles, 4.3 grams of silicone oil (Dow PMX-200), and 20 grams of small silica (TG308F from Cabot Corp.) are added into the blender and mixed for 16 minutes at 2048 rpm. The final toner is removed and air-jet screened through a 37 um mesh screen to remove any coarse particles prior to installation into the machine for testing. This resin particle was 5.8 μm in diameter on average and nearly spherical with a circularity 0.988.

Comparative Example 3

Preparation of Control Toner Sample

In a Henshel blender, 3.3 pounds of Styrene/Acrylate resin particles and 20 grams of small silica (TG308F from Cabot Corp.) are blended for 16 minutes at 2048 rpm. The final toner is removed and air-jet screened through a 37 um mesh screen to remove any coarse particles prior to installation into the machine for testing. This resin particle was 5.8 μm in diameter on average and nearly spherical with a circularity 0.988.

Evaluation of Toner Samples

Extensive testing as shown that the higher circularity is required to prevent the solid density from degrading over the life of the cartridge. As the circularity decreases, the density stability over life decreases. Without the silica that has been mixed with silicone oil, the cleaning system is incapable of cleaning this highly spherical particle using the aftermarket photoreceptor and cleaning blades currently used in the xerographic cartridge.

FIG. 2 shows the relative cleaning performance of the inventive toners as compared to a control toner when tested in the stress condition (low RH/low temp at a three page job length). At every 1000 pages, a clear tape is adhered to the photoreceptor at a position immediately after the cleaning blade contact nip and subsequently adhered to a white paper substrate. Any cleaning streaks created in the cleaning nip are adhered to the tape and become visible against the white substrate. Each streak is counted and recorded in the table as shown. As can be seen, the inventive toners performed better in general than the control toner.

Figure 3:
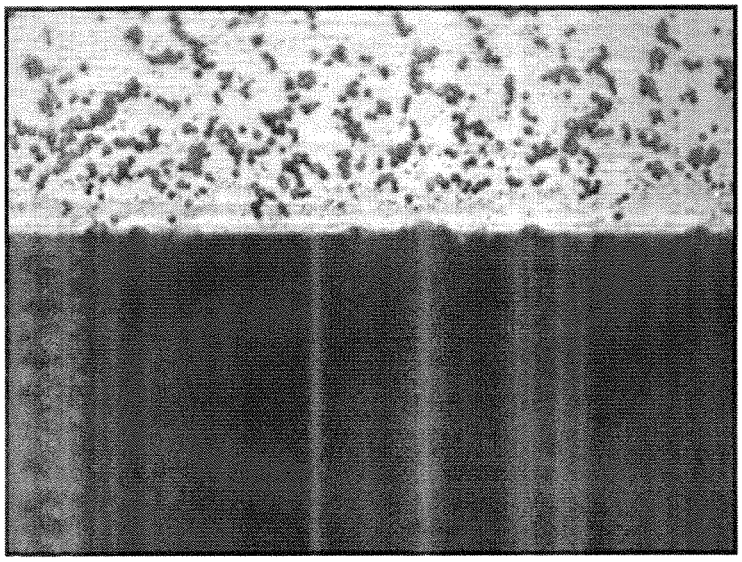
FIG. 3 is a photo micrograph showing the blade edge that has been torn after use on a control toner without the additive.
Figure 4:
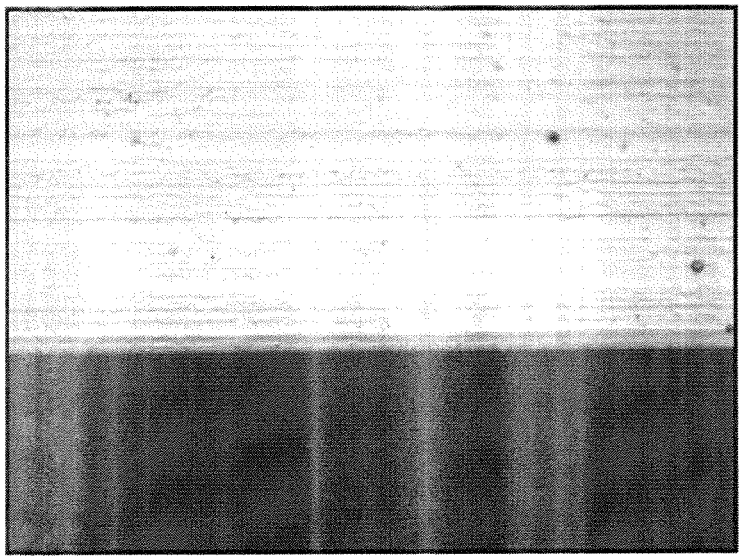
FIG. 4 is a photo micrograph showing a clean blade edge after use on a toner made according to the present embodiments.

In addition, FIGS. 3 and 4 show photo micrographs of the cleaning blade edge after printing 7,000 pages with a toner comprising an oiled silica at 50% of the total silica versus a toner comprising 100% un-oiled silica. The pictures show clearly show how the blade edge is nearly pristine when used with the inventive toner (FIG. 4) as compared to the torn edge of the control toner (FIG. 3) and demonstrates how well the cleaning performance is improved.

As can be seen from the test results, the addition of the silicone oil greatly improved the cleaning functionality in the stress condition. The tests demonstrated that the silicone oil does not adversely impact the excellent toner density and background stability. The example toner composition exhibited similar density and background performance to an OEM cartridge running as a control.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A process for producing a toner composition comprising:

mixing together a resin, a colorant, a wax, and an optional charge control agent to form toner particles in a first mixing step;

mixing together a first inorganic fine powder and silicone oil to form an oiled inorganic fine powder in a second mixing step; and adding the oiled inorganic fine powder to the toner particles and mixing the oiled inorganic fine powder and toner particles together to form final toner particles, wherein no heat treatment is required to adhere the silicone oil to the inorganic fine powder.

2. The process of claim 1, wherein a second inorganic fine powder is added to the first inorganic fine powder and silicone oil in the second mixing step.

3. The process of claim 1, wherein the final toner particles are further screened to remove any coarse particles.

4. The process of claim 1, wherein the final toner particles have a circularity of greater than 0.975.

5. The process of claim 1, wherein the final toner particles have an average particle size of from about 4 to about 9 μm.

6. The process of claim 1, wherein the first and second inorganic fine powder are the same.

7. The process of claim 1, wherein the inorganic fine powder is selected from the group consisting of silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, silicon nitride, and mixtures thereof.

8. The process of claim 1, wherein the silicone oil is selected from the group consisting of dimethylsilicone oil, methylphenylsilicone oil, methylhydrogensilicone oil, alkyl-modified silicone oils, chloroalkyl-modified silicone oils, chlorophenyl-modified silicone oils, fatty acid-modified silicone oils, polyether-modified silicone oils, alkoxy-modified silicone oils, carbinol-modified silicone oils, amino-modified silicone oils, fluorine-modified silicone oils, and mixtures thereof.

9. The process of claim 1, wherein the silicone oil has a viscosity of from about 10 to about 1,000 centistokes at room temperature.

10. The process of claim 1, wherein the silicone oil is present in the toner composition in an amount of between 500 and 3500 parts per million (ppm).

11. A process for producing a toner composition comprising:

mixing together a resin, a colorant, a wax, and an optional charge control agent to form toner particles;

adding a first inorganic fine powder and silicone oil to the toner particles and mixing the first inorganic fine powder, silicone oil and resin particles together to form final toner particles, wherein no heat treatment is required to adhere the silicone oil to the inorganic fine powder.

12. A toner composition comprising toner particles further comprising a resin, a colorant, a wax, and an optional charge control agent; and an additive comprising a first inorganic fine powder and a silicone oil, wherein the first inorganic fine powder and a silicone oil are mixed directly with the toner particles to form final toner particles and no heat treatment is required to adhere the silicone oil to the inorganic fine powder.

13. The toner composition of claim 12, wherein the final toner particles have a circularity of greater than 0.975.

14. The toner composition of claim 12, wherein the final toner particles have an average particle size of from about 4 to about 9 μm.

15. The toner composition of claim 12, wherein the inorganic fine powder is selected from the group consisting of silica, alumina, titanium oxide, barium titanate, magnesium titanate, calcium titanate, strontium titanate, zinc oxide, quartz sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, silicon nitride, and mixtures thereof and wherein the silicone oil is selected from the group consisting of dimethylsilicone oil, methylphenylsilicone oil, methylhydrogensilicone oil, alkyl-modified silicone oils, chloroalkyl-modified silicone oils, chlorophenyl-modified silicone oils, fatty acid-modified silicone oils, polyether-modified silicone oils, alkoxy-modified silicone oils, carbinol-modified silicone oils, amino-modified silicone oils, fluorine-modified silicone oils, and mixtures thereof.

16. The toner composition of claim 12, wherein the silicone oil has a viscosity of from about 10 to about 1,000 centistokes at room temperature.

17. The toner composition of claim 12, wherein the silicone oil is present in the toner composition in an amount of between 500 and 3500 parts per million (ppm).

18. An image forming system comprising:

an electrostatic latent image bearing member for holding thereon an electrostatic latent image;

a developing assembly for developing the electrostatic latent image held on the electrostatic latent image bearing member, wherein the developing assembly comprises a self-cleaning toner composition for developing an electrostatic latent image;

a toner container for holding the self-cleaning toner composition; and a toner carrying member for carrying the self-cleaning toner composition held in the toner container and transporting the self-cleaning toner composition to an area on the electrostatic latent image bearing member where the electrostatic latent image is developed; and a cleaning unit for cleaning the surface of the electrostatic latent image bearing member, wherein the self-cleaning toner composition comprises final toner particles comprising toner particles further comprising a resin, a colorant, a wax, and an optional charge control agent; and an additive comprising a first inorganic fine powder and a silicone oil, wherein the first inorganic fine powder and a silicone oil are mixed directly with the toner particles to form final toner particles and no heat treatment is required to adhere the silicone oil to the inorganic fine powder.

19. The image forming system of claim 18, wherein the cleaning unit comprises a cleaning blade.

20. The image forming system of claim 19, wherein the cleaning blade exhibits little to no wear from cleaning the final toner particles from the latent electrostatic image bearing member after printing 20,000 pages.

* * * * *